US005404721A

United States Patent [19]

Hartsock

[11] Patent Number: 5,404,721

[45] Date of Patent: Apr. 11, 1995

[54] CAST-IN-PLACE CERAMIC MANIFOLD AND METHOD OF MANUFACTURING SAME

[75] Inventor: Dale L. Hartsock, Livonia, Mich.

[73] Assignee: Ford Motor Company, Dearborn, Mich.

[21] Appl. No.: 188,010

[22] Filed: Jan. 28, 1994

[51] Int. Cl.[6] ..... F01N 3/20

[52] U.S. Cl. ..... 60/300; 60/323; 60/324

[58] Field of Search ..... 60/272, 273, 274, 282, 60/300, 301, 302, 303, 322, 323, 324

[56] References Cited

U.S. PATENT DOCUMENTS

| | | | |
|---|---|---|---|
| 3,488,723 | 1/1970 | Veazie | 60/323 |
| 3,568,723 | 3/1971 | Sowards | 138/143 |
| 3,807,173 | 4/1974 | Zmuda | 60/282 |
| 4,077,458 | 3/1978 | Hayashi | 60/282 |
| 4,205,420 | 6/1980 | Bothwell | 29/157 |
| 4,206,598 | 6/1980 | Rao et al. | 60/282 |
| 4,849,266 | 7/1989 | Dwivedi et al. | 428/34.4 |
| 4,884,400 | 12/1989 | Tanaka et al. | 60/323 |
| 4,890,663 | 1/1990 | Yarahmadi | 164/98 |
| 5,014,903 | 5/1991 | Cyb | 228/176 |
| 5,020,319 | 6/1991 | Matsuura et al. | 60/321 |
| 5,052,463 | 10/1991 | Lechner et al. | 164/35 |
| 5,137,789 | 8/1992 | Kaushal | 428/472 |
| 5,142,863 | 9/1992 | Ushio et al. | 60/272 |

FOREIGN PATENT DOCUMENTS

| | | |
|---|---|---|
| 0292777 | 3/1988 | European Pat. Off. . |
| 64-53761 | 1/1989 | Japan . |
| 3189062 | 6/1991 | Japan . |

*Primary Examiner*—Ira S. Lazarus
*Assistant Examiner*—Daniel J. O'Connor
*Attorney, Agent, or Firm*—Roger L. May; Joseph W. Malleck

[57] ABSTRACT

An exhaust manifold (10) for directing heated exhaust gas from an internal combustion engine (12), the manifold comprising a manifold body (32) having an outer wall (34), and an inner wall (42) defining an exhaust passageway (43) for directing the heated exhaust gas. The inner wall (34) has embedded therein a plurality of ceramic members (58) having a lower thermal conductivity than that of the manifold body (32) such that heat transfer through the ceramic members (58) to the outer wall (34) is reduced. The invention also includes a method of manufacturing same.

16 Claims, 3 Drawing Sheets

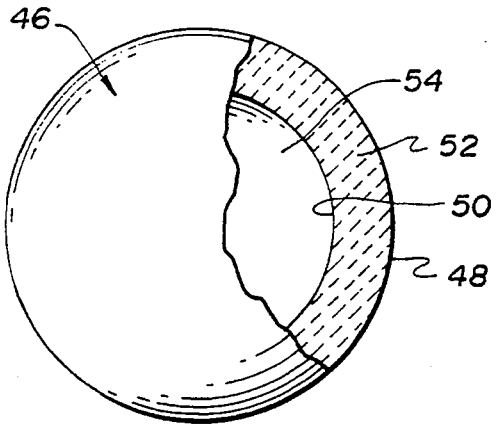
Fig. 2
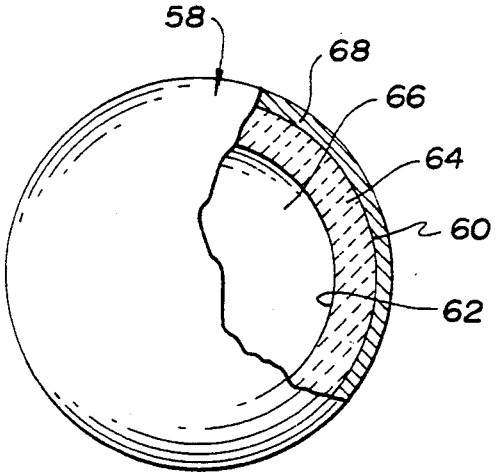
Fig. 3
Fig. 4
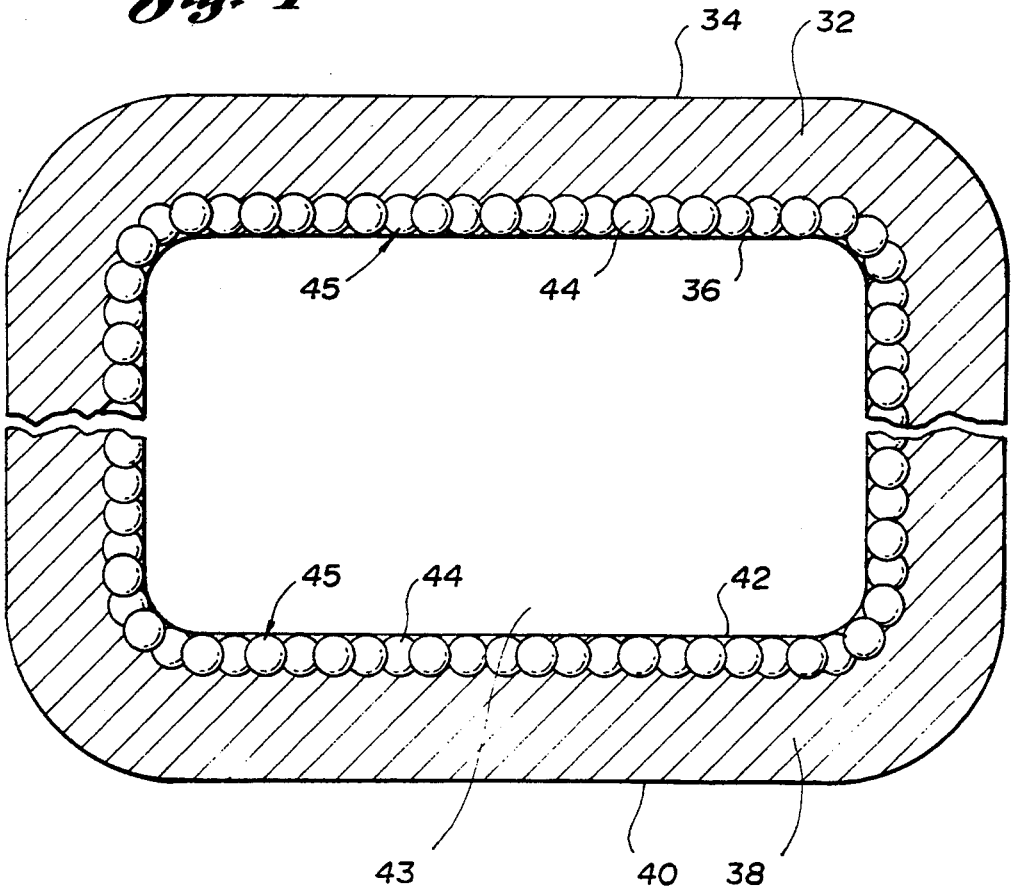

CAST-IN-PLACE CERAMIC MANIFOLD AND METHOD OF MANUFACTURING SAME

TECHNICAL FIELD

The present invention relates to an exhaust manifold for an internal combustion engine, and more particularly, to an exhaust manifold having an inner wall including embedded ceramic members for insulating the exhaust passageway of the exhaust manifold.

BACKGROUND ART

As government controls on internal combustion engine emissions become more strict, there arises an increased concern for more effective operation of the systems that reduce harmful engine emissions. Attention has been turned to conventional catalytic converters and their operation. It is known that conserving the residual heat of exhaust gases of an internal combustion engine so that the downstream catalytic converter may operate with higher efficiency and effectiveness reduces the emission levels of the engine. More specifically, in order to meet new emission standards, it is necessary to get the exhaust system catalyst to "light off" very quickly because a high percentage of total emissions occur during cold start, before the catalysts are active. Solutions to this problem must be inherently durable, yet not introduce any additional engineering or manufacturing problems into production of the automobile.

Various solutions have been advocated which include cast-in-place heat insulating type liners. Insertable liners may be added independently of the fabrication of the exhaust manifold. Coatings may be applied directly to the prefabricated engine components including asbestos and other ceramic materials. But cast-in-place type liners are affected by shrinkage and solidification of the cast metal around the liner and have led to localized peeling and/or separation of the cast-in-place liners from the engine component which eventually leads to damage, leaks, and inadequate insulation. Insertable type liners often develop sealing difficulties.

The disadvantages of coatings are specifically related to their fragile nature. This is particularly amplified when the cast housing is subjected to mechanical or chemical treatments, which may tend to fracture or chip the coatings. Coating systems also require multiple manufacturing steps, which result in increased manufacturing costs. Further, thin coatings are ineffective because the minimal thickness does not produce a thermal resistance sufficient to overcome the increased heat transfer caused by the increased roughness of the thin coating surface.

One further solution which has been suggested, is to lower the thermal mass of the exhaust manifold and exhaust pipe in front of the catalytic converter. This solution requires reducing the thermal mass of the exterior manifold by reducing the thickness of the manifold and/or exhaust pipes. In this system, a thin walled inner pipe is enclosed in a thicker walled outer pipe which is provided for overall structural integrity. The thicker walled pipe provides a cooler outer wall surface adjacent to the other engine and body components due to the air gap.

The thickness of the inner pipe is normally limited to dimensions that can be fabricated and still retain sufficient structural integrity. As the inner and outer pipes operate at different temperatures, a means for allowing the differential thermal expansion is often included in the above discussed inner and outer pipe designs. The inner and outer pipe design incorporates a sliding joint or a convoluted pipe design which is fairly complex. The sliding joint must be carefully designed to avoid the high probability of a fracture or failure in use over an extended period of time.

U.S. Pat. No. 4,890,663 issued to Yarahadi discloses a method for producing a metallic component provided with a ceramic lining. A first ceramic layer is applied to a mold, a second sliding layer is applied to the first ceramic layer and a second ceramic layer is thereby divided by joints into individual zones and is applied to the sliding layer. Lastly, the second ceramic layer is coated with a metal to form a finished component.

U.S. Pat. No. 4,884,400 issued to Tanaka, et al. discloses an exhaust manifold for an internal combustion engine which comprises an outer body of aluminum having a configuration corresponding to an exhaust manifold and an insulating layer of ceramic fiber disposed on the inner surface of the outer body for protecting the outer body from heated exhaust gas. A protector is incorporated within the insulating layer in a manner to maintain the disposition and configuration of the insulating layer.

SUMMARY OF THE INVENTION

A primary object of the present invention is to provide an exhaust manifold for an internal combustion engine, the manifold having an outer wall and an inner wall defining an exhaust passageway for directing the heated exhaust gas. The inner wall has embedded therein a plurality of ceramic members having a lower thermal conductivity than that of the manifold body such that heat transfer through the ceramic members to the outer wall is reduced.

Another object of the present invention is to provide an exhaust manifold for an internal combustion engine wherein the above specified ceramic members are hollow ceramic spheres which are partially encapsulated by the inner wall. The spheres form a substantially continuous layer extending along the inner wall.

Still another object of the present invention is to provide an exhaust manifold for an internal combustion engine wherein the hollow ceramic spheres are coated with a layer of crushable material for protecting the ceramic spheres from compression forces created by the differences in thermal contraction of the cast manifold body and the ceramic spheres.

BRIEF DESCRIPTION OF THE DRAWINGS

FIG. 2 is an enlarged, partially fragmented, sectional view of a ceramic sphere of the present invention;

FIG. 3 is an enlarged, partially fragmented, sectional view of a ceramic sphere of an alternative embodiment of the present invention;

FIG. 4 is a sectional view taken along line 4—4 of FIG. 1, illustrating the ceramic spheres embedded in the exhaust manifold of the present invention.

BEST MODES FOR CARRYING OUT THE INVENTION

Figure 1:
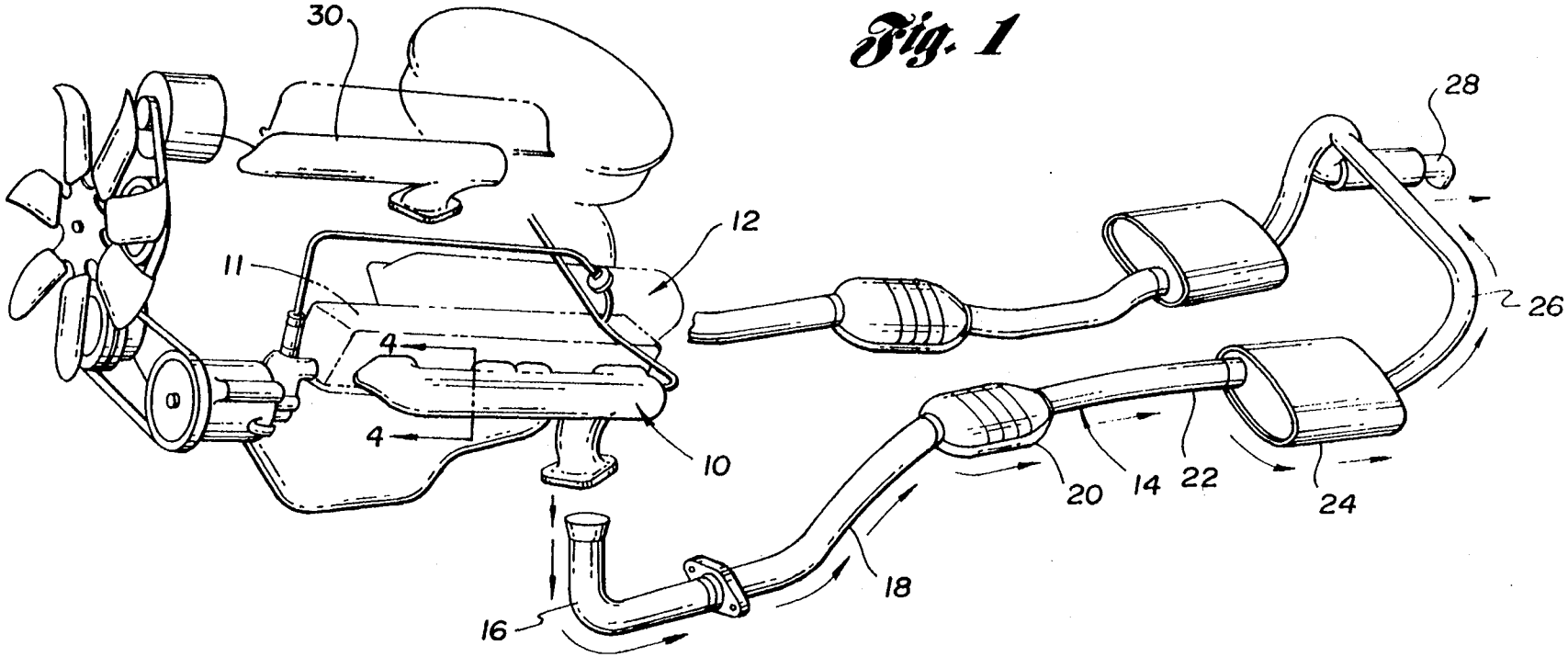
FIG. 1 is an environmental view of an exhaust system for an internal combustion engine, showing the exhaust system in partially diagrammatic form.

Referring now to FIG. 1 there is shown generally, an exhaust manifold 10 of the present invention. Exhaust manifold 10 is further shown operatively affixed to an internal combustion engine 12, shown in partial diagrammatic form. The internal combustion engine 12 illustrated is connected to a cylinder head 11 of a conventional dual exhaust system 14, for exemplary purposes only. The exhaust manifold of the present invention may be used in conjunction with any exhaust system and internal combustion engine where exhaust gases exit the engine and must be directed out and away from the vehicle to the atmosphere.

The exhaust system 14 comprises an exhaust pipe 16, a connecting pipe 18, a catalytic converter 20, a straight pipe 22, a muffler 24, a second connecting pipe 26 and a tail pipe 28. As can be seen from the drawing, a second exhaust manifold 30 is connected to the opposite side of the engine 12. As the operation of the exhaust manifold 10 will be substantially identical to the operation of exhaust manifold 30, reference will be made only to the characteristics and operation of exhaust manifold 10 and the connected exhaust system 14.

In general, the internal combustion engine 12 first conveys exhaust gas directly to the cylinder head 11, from the cylinders (not shown) to the exhaust manifold 10. The exhaust gas passes through the exhaust manifold 10, through the exhaust pipe 16, connecting pipe 18 and to the catalytic converter 20, as illustrated by the directional arrows. The exhaust gas continues through the catalytic converter 20, to the straight pipe 22, through the muffler and second connecting pipe and out into the atmosphere at the rear of the vehicle (not shown).

Referring now to FIG. 4, there is shown an enlarged view of the preferred embodiment of manifold 10 having a manifold body section 32 having an outer wall 34 and an inner wall 36. Similarly, manifold section 38 has a outer wall 40 and an inner wall 42. Inner walls 36 and 42 define an exhaust passageway 43 for directing the exhaust gas away from the engine 12, through the exhaust and connecting pipes 16 and 18 respectively and to the catalytic converter 20.

In the preferred embodiment of the present invention, a plurality of ceramic spheres 44 are positioned directly adjacent the inner walls 36 and 42. The ceramic spheres are further preferably arranged in a single, substantially continuous layer 45, but multiple layers (not shown) of spheres are within the scope of the invention. As the manifold body sections 32 and 38 are substantially identical, and illustration thereof has been included for clarity only, reference will be made to manifold section 32 as exemplary of both manifold sections.

The ceramic spheres 44 are preferably cast in place, as will be discussed in further detail below with respect to the method of manufacture of the present invention, such that the manifold body 32 completely encompasses and surrounds each ceramic sphere 44. In this fashion, the inner wall 36 is in direct contact with the exhaust gas from the engine 12 and also has disposed directly adjacent the inner wall 36, the layer of ceramic spheres 44. It is further contemplated that manifold body section 32 may have ceramic members embedded therein which are not spherical in shape. Cubic, elliptical, and rectangular shaped ceramic members are also within the scope of the present invention, as is any shape that is amenable to disposition in a manifold body.

Referring now to FIG. 2, there is shown a preferred hollow ceramic sphere 46. Ceramic sphere 46 has an outer surface 48, an inner surface 50 and a base portion 52 defined therebetween. The inner surface 50 further defines the shape of an inner cavity 54. The inner cavity 54 may be filled with a gas, for example air, or may be substantially devoid of gas, as in a vacuum. The preferred embodiment of the present invention uses a ceramic sphere 46 which encapsulates air.

The outer diameter of the ceramic sphere is preferably within a range from 1.5 to 5.0 millimeters. The sphere wall thickness, i.e. the distance from the outer surface 48 to the inner surface 50, as shown in FIG. 2, is preferably in a range from 0.025 to 0.160 millimeters. The preferred ceramic sphere of the present invention is manufactured from any one of the following materials: alumina ($Al_2O_3$), zirconia, silicon nitride, silica, and any combination thereof and is provided by Microcel Technology Inc. of New Jersey under the name Cermacel TM.

Referring now to FIG. 3, there is shown another alternative hollow ceramic sphere 58 of the present invention. The ceramic sphere 58 includes a ceramic outer surface 60, and inner surface 62 and a base 64 extending therebetween. The inner surface 62 further defines the shape of an inner cavity 66.

The ceramic sphere 58 additionally includes a layer 68 of crushable material entirely encasing the outer surface 60 of sphere 58. This crushable material should be fracturable or structurally degradable to the extent that the compressive forces exerted upon the layer 68 during cooling of the metal used to cast the exhaust manifold body section 32 around the ceramic sphere 58 are sufficient to initiate crushing. More specifically, in a cast-in-place embodiment where a molten metal is cast around the ceramic spheres, it is known that the differences in thermal expansion and contraction may cause a compression or contraction of the cast metal around the ceramic spheres upon cooling. The crushable material layer 68 is provided to insure protection and cushioning of the inner ceramic sphere outer surface 60 from the destructive forces.

Still referring to FIG. 3, the inner cavity 66 of ceramic sphere 58, may, as discussed similarly above with respect to sphere 46, be filled with a gas, for example air, or may be substantially devoid of gas, as in a vacuum. The preferred embodiment of the present invention uses a crushable material layer 68 of low density fused silica.

Having described the structural characteristics of the present invention, attention is now turned to the advantageous operational characteristics derived therefrom. Initially it is understood that catalytic converters work best at temperatures ranging from 1,000 to 1,500 degrees Fahrenheit, thereby transforming harmful emission gases into harmless carbon dioxide and water vapor. This is particularly advantageous to insulate the exhaust manifold structure in such a fashion as to conserve as much heat within the exhaust gases as possible. The hotter the exhaust gases are upon entry into the catalytic converter, the faster the catalytic converter reaches "light off" temperature or maximum operating condition. The catalytic converter, as discussed above, works less efficiently until the "light off" temperature is reached. Below that temperature, more harmful gases may be introduced into the air than if the converter were operating at a maximum ("light off") operating condition.

The exhaust manifold 10 of the present invention, having the ceramic spheres 44 embedded therein provides a heat insulating layer within the manifold body section 32 for decreasing the loss of heat from the exhaust gases traveling along the exhaust passageway 43. More specifically, the ceramic spheres have an inherently lower thermal conductivity and lower thermal mass than that of the cast metal manifold outer wall surface 34, thereby reducing the amount of transient and steady state heat transfer radially outwardly from the inner wall 36 of the manifold body section 32 to the outer wall surface 34.

The present invention provides advantages over the prior art in that the ceramic spheres are not subject to cracking or peeling, as in the ceramic liner applications discussed above because the ceramic sphere are mechanically or structurally locked in position within the manifold body section 32. The ceramic spheres are completely encompassed by the inner wall 36, and are protected from mechanical damage due to use. Thus, the exhaust manifold 10 of the present invention provides an economical, highly efficient means of insulating the exhaust gases from heat loss through the exhaust manifold walls.

Figure 5:
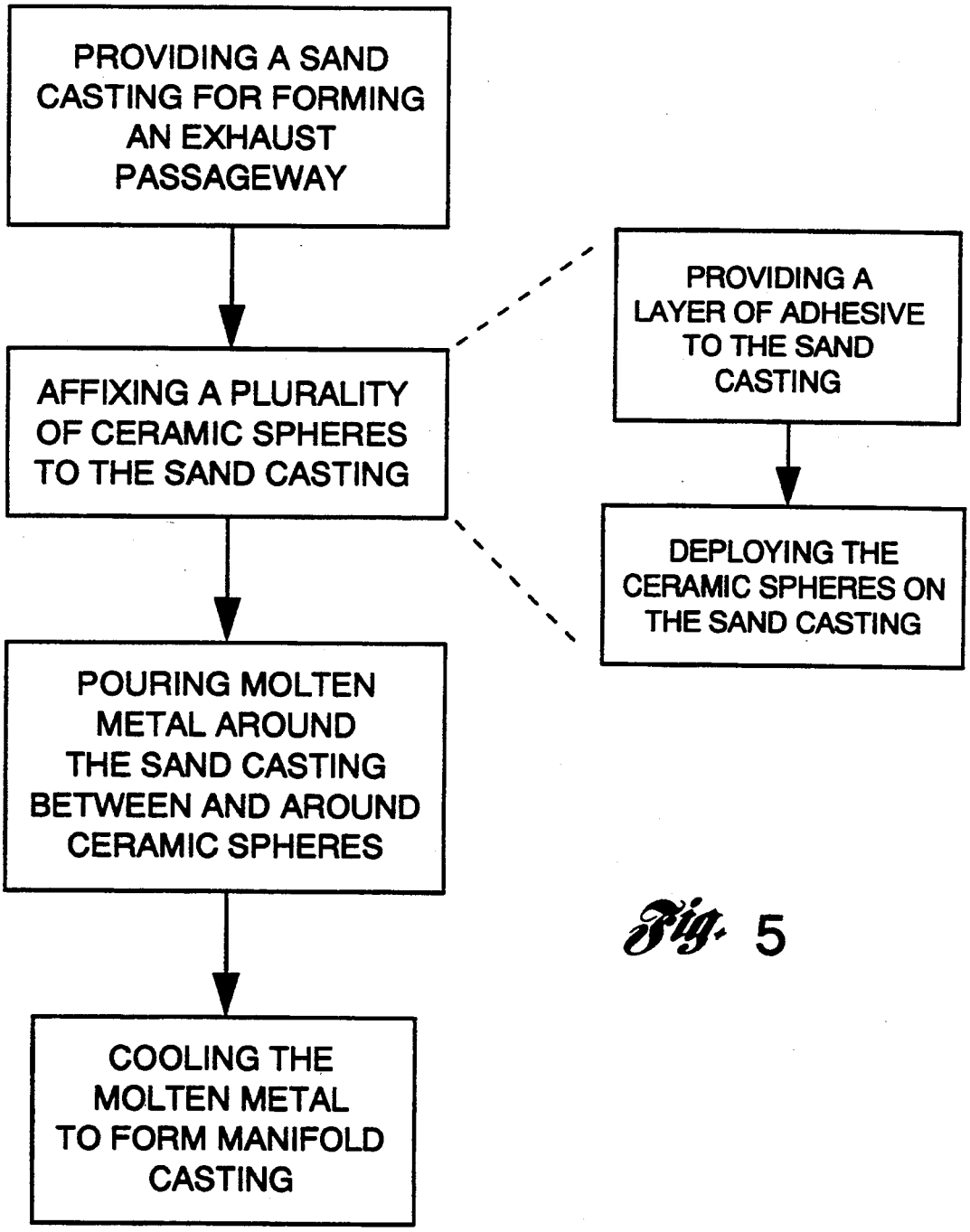
FIG. 5 is a diagrammatical view of the method of manufacturing the exhaust manifold of the present invention.

Referring to FIG. 5, the method of manufacturing the exhaust manifold of the present invention comprises the following steps:

a) providing a sand casting for forming the exhaust passageway 43;

b) affixing a plurality of ceramic members 44 to the sand casting;

c) pouring a molten material around the sand casting and between and around the ceramic members 44;

d) cooling the molten material to form a manifold casting so that solidified material interposed between exhaust manifold 10 around the ceramic spheres 44 fixedly secures the ceramic spheres to an inner wall of the exhaust passageway, thereby imbuing the exhaust passageway with thermally insulating properties so that exhaust gases passing in contact therewith retain their high temperature and so that a catalytic converter may quickly achieve a light-off temperature; and e) removing the sand casting from the manifold casting.

In the preferred embodiment, the molten material is iron, providing a cast iron exhaust manifold having embedded therein ceramic spheres 44. It is within the scope of the present invention to use other materials such as aluminum and other metals and metal alloys conventionally used to manufacture exhaust manifolds.

The step of affixing the plurality of ceramic members to the sand casting further comprises the steps of:

a) providing an adhesive to the ceramic members; and b) deploying the ceramic members on the sand casting.

Alternatively, the step of affixing the plurality of ceramic members to the sand casting comprises the steps of:

a) providing a layer of adhesive to the sand casting; and b) deploying the ceramic members on the sand casting.

In the preferred method of manufacturing the present invention, the step of affixing the ceramic members comprises applying the adhesive to the sand casting initially. The adhesive used in the preferred method is a sodium silicate adhesive or a phosphate cement.

The best mode for carrying out the invention has been described in detail, those familiar with the art to which this invention relates will recognize various alternative designs and embodiments for practicing the invention as defined by the following claims.

I claim:

1. A manifold for directing heated exhaust gas from an internal combustion engine, the manifold comprising:

a manifold body having an outer wall, and an inner wall which is in thermal communication with said heated exhaust gas, said inner wall having embedded therein a plurality of ceramic members having a lower thermal conductivity and thermal mass than that of said inner wall such that heat transfer through said ceramic members to said outer wall is reduced, so that exhaust gases passing in contact therewith retain their high temperature and so that a catalytic converter may quickly achieve a light-off temperature.

2. The manifold of claim 1 wherein said ceramic members comprise ceramic spheres.

3. The manifold of claim 2 wherein said ceramic spheres are encompassed by said inner wall, the ceramic spheres forming a substantially continuous layer having a thickness of at least one ceramic sphere extending along said manifold body.

4. The manifold of claim 2 wherein said ceramic spheres are encompassed by said inner wall, forming a single substantially continuous layer extending along said manifold body.

5. The manifold of claim 2 wherein said ceramic spheres are encompassed by said inner wall, forming a single substantially continuous layer extending along said manifold body adjacent to said inner wall.

6. The manifold of claim 1 wherein said members are hollow.

7. The manifold of claim 6 wherein said members define a hollow inner space filled with a gas.

8. The manifold of claim 6 wherein said members have a hollow inner space encapsulating a vacuum.

9. The manifold of claim 2 wherein said spheres have a uniform diameter within a range from 1.5 mm to 5.0 mm.

10. The manifold of claim 1 wherein said ceramic members are selected from the group consisting of alumina, zirconia, silicon nitride, silica, and mixtures thereof.

11. The manifold of claim 1 wherein said ceramic members are encased within a layer of crushable material so that said members may withstand dimensional changes imposed by thermal expansion and contraction of said manifold body.

12. The manifold of claim 1 wherein said manifold body is comprised of iron.

13. An exhaust manifold for directing heated exhaust gas from an internal combustion engine, said exhaust manifold comprising:

a manifold body having an inner wall which is in thermal communication with said heated exhaust gas, said inner wall having therein a plurality of ceramic spheres having a lower thermal conductivity than that of said outer wall such that said heat transfer through said inner wall to said outer wall is reduced, so that exhaust gases passing in contact therewith retain their high temperature and so that a catalytic converter may quickly achieve a light-off temperature.

14. The exhaust manifold of claim 13 wherein said ceramic spheres are completely encompassed by said inner wall, the ceramic spheres forming a continuous layer having a thickness of at least one ceramic sphere along said manifold body.

15. The exhaust manifold of claim 13 wherein said spheres have a diameter within a range from 1.5 mm to 5 mm.

16. The exhaust manifold of claim 13 wherein said ceramic spheres are comprised of a material chosen from the group consisting of alumina, zirconia, silicon nitride or silica.

* * * * *